US005088300A

United States Patent [19]

Wessa

[11] Patent Number: 5,088,300

[45] Date of Patent: Feb. 18, 1992

[54] ARRANGEMENT FOR MAKING, PROPORTIONING, DISCHARGING AND STORING SMALL CLEAR ICE BODIES

[76] Inventor: Theo Wessa, Siedlung 19, 6751 Mackenbach/Pfalz, Fed. Rep. of Germany

[21] Appl. No.: 623,285

[22] Filed: Dec. 5, 1990

[30] Foreign Application Priority Data

Dec. 5, 1989 [EP] European Pat. Off. ..... 89122443

[51] Int. Cl.[5] ..... F25C 5/18

[52] U.S. Cl. ..... 62/340; 62/344

[58] Field of Search ..... 62/340, 344, 256, 255, 62/254, 60, 67

[56] References Cited

U.S. PATENT DOCUMENTS

| | | | |
|---|---|---|---|
| 3,151,668 | 10/1964 | Zimmermann | 62/344 X |
| 3,543,811 | 12/1970 | Lamka | 62/344 X |
| 3,613,389 | 10/1971 | Ohlsson et al. | 62/344 X |
| 3,807,193 | 4/1974 | McKenney et al. | 62/344 X |
| 3,913,343 | 10/1975 | Rowland et al. | 62/344 X |
| 3,918,266 | 11/1975 | Gindy et al. | 62/344 X |
| 4,084,725 | 4/1978 | Buchser | 62/344 X |
| 4,088,243 | 5/1978 | Deveson | 62/344 X |
| 4,252,002 | 2/1981 | Mullins, Jr. | 62/344 |
| 4,404,817 | 9/1990 | Cox, III . | |
| 4,512,502 | 4/1985 | Landers | 62/344 X |
| 4,689,937 | 9/1987 | Einan, Sr. et al. | 62/344 X |
| 4,732,301 | 3/1988 | Tobias et al. | 62/344 X |
| 4,771,609 | 9/1988 | Funabashi | 62/344 X |
| 4,972,682 | 11/1990 | Smith et al. | 62/255 X |

FOREIGN PATENT DOCUMENTS

| | | | |
|---|---|---|---|
| 2454348 | 5/1975 | Fed. Rep. of Germany . | |
| 2544846 | 10/1984 | France | 62/344 |

*Primary Examiner*—Henry A. Bennet
*Assistant Examiner*—Christopher B. Kilner
*Attorney, Agent, or Firm*—Toren, McGeady & Associates

[57] ABSTRACT

An arrangement for making, proportioning, discharging and storing small clear ice bodies includes at least one freezer unit for continuously producing small ice bodies from water. An insulated housing arranged underneath the at least one freezer unit for the immediate storage of the small ice bodies includes means for revolving the small ice bodies and for conveying the small ice bodies to an outlet opening in the bottom of the housings. The intermediate storage housing has a bottom plate which is inclined toward the outlet opening. A pipe screw is provided for revolving and conveying the small ice bodies. A unit for proportioning and filling includes a filling chamber arranged underneath the outlet openings. A bag storage housing is arranged underneath the intermediate storage housing and includes at least one inlet opening which is positioned in the region of the proportioning and filling unit. The bag storage housing has at least one opening for removing the filled bags. A unit for generating a veil of cold air and for lowering the temperature below the freezing point is positioned above the removal opening.

20 Claims, 1 Drawing Sheet

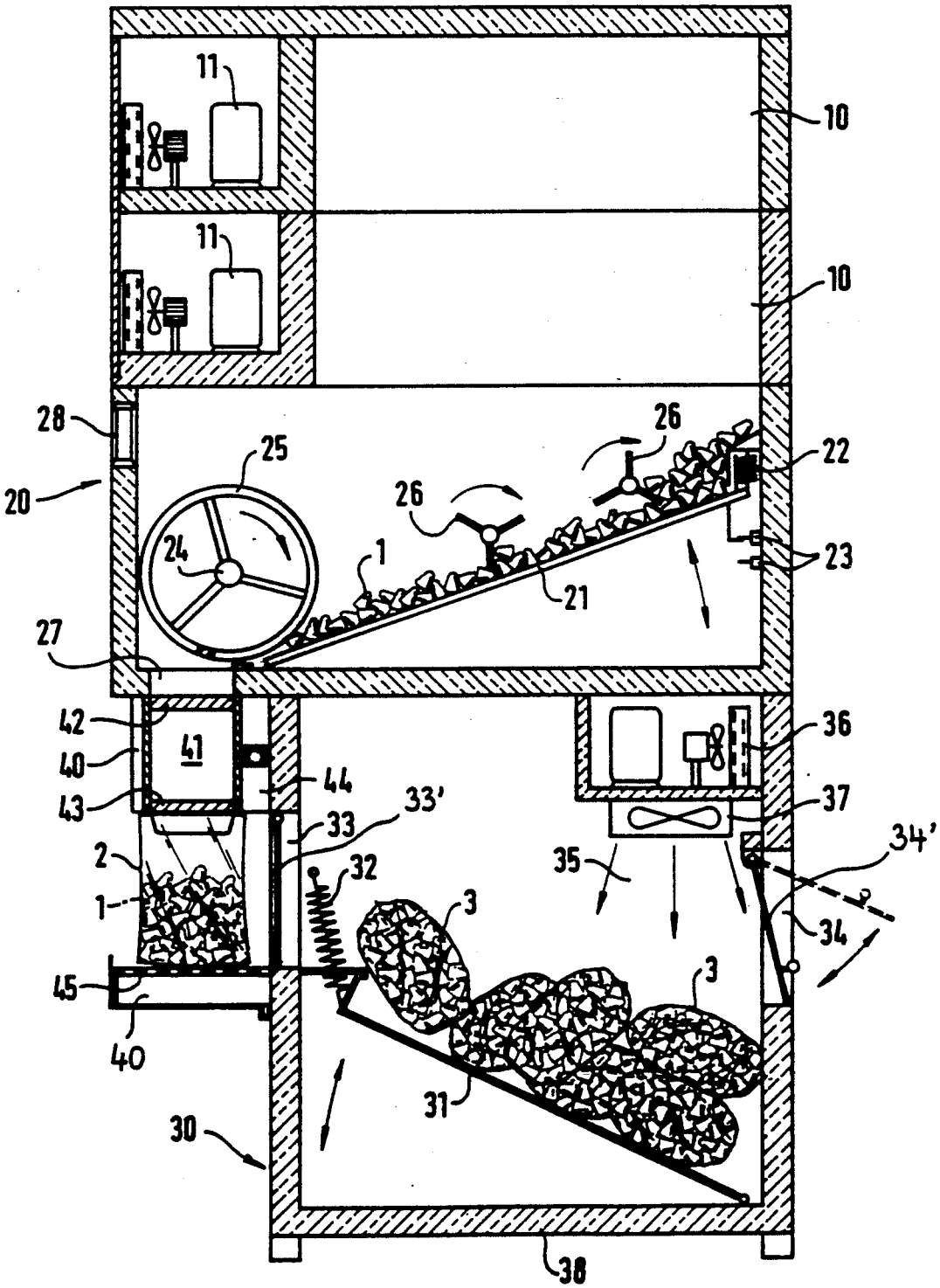
11
10
11
10
28
25
26
22
20
26
24
1
23
21
27
42
41
36
40
44
37
43
33'
33
34'
2
32
35
1
3
34
45
3
40
31
30
38

ARRANGEMENT FOR MAKING, PROPORTIONING, DISCHARGING AND STORING SMALL CLEAR ICE BODIES

BACKGROUND OF THE INVENTION

1. Field of the Invention

The present invention relates to an arrangement for making, proportioning, discharging and storing small clear ice bodies. The arrangement includes at least one freezer unit for continuously producing small ice bodies from water; an insulated housing for the intermediate storage of the small ice bodies which further includes means for revolving the small ice bodies and for conveying the small ice bodies to an outlet opening in the bottom of the housing; and a unit for proportioning and filling the small ice bodies into bags and an insulated housing for storing the filled bags.

2. Description of the Related Art

Various types of arrangements for manufacturing small clear ice bodies by freezing water are known. Commercially available machines can produce up to 1000 kg of small ice bodies per day.

For handling the small ice bodies in an hygienic as well as economic manner, so-called dispensers have been developed in which the small ice bodies are stored and dispensed in controllable amounts as required. These dispensers include essentially an insulated housing into which the prepared small ice bodies are dropped from the top and in which they are revolved by means of a device, frequently in the form of a pipe screw, in order to prevent the small ice bodies from freezing together and from which they are discharged, for example, through a discharge opening in the bottom. Such arrangements are known from German Offenlegungsschrift 24 54 348 and U.S. Pat. Nos. 4,084,725; 4,512,502; 3,543,811; 4,404,817 and 4,771,609.

An arrangement of the above-described type is commercially available. The arrangement includes essentially a thermally insulated, cylindrical fiberglass silo with a cover, wherein one or two small ice body makers are positioned on the cover. The center of the bottom of the silo has an outlet opening under which a conveyor screw begins. In the silo there is provided a screw which rotates about the center axis of the silo and which loosens the supply of small ice bodies and conveys them to the outlet opening.

In supermarkets, airports, fish processing plants, catering companies and the like, the small ice bodies are produced centrally in large quantities and are transported packed in plastic bags to the locations of the users. In order to prevent the small ice bodies from melting in the bags, the bags are stored in separate freezer rooms at temperatures below the freezing points. The transport to the user locations takes place in vehicles or containers which have their own cooling systems. At the user locations, another intermediate storage may take place in special freezer rooms or containers.

It is apparent that it is very cumbersome and time-consuming to make available freezer rooms or containers for the intermediate storage of the bags filled with small ice bodies and to transport the bags which have been filled at a central location with small ice bodies in the transport units which have their own cooling systems to the locations of the users.

SUMMARY OF THE INVENTION

It is, therefore, the primary object of the present invention to provide an arrangement of the above-described type which can be made available in very different sizes and which includes a freezer unit for continuously producing the small ice bodies from water, an insulated housing for the intermediate storage of the small ice bodies with the necessary means for revolving the small ice bodies and for conveying the small ices bodies to an outlet opening at the bottom of the housing, a unit for proportioning and filling the small ice bodies into bags and an insulated housing for storing the filled bags.

In accordance with the present invention, the freezer unit is mounted above the intermediate storage housing and the intermediate storage housing is mounted above the bag storage housing. The intermediate storage housing has a bottom plate which is inclined toward the outlet opening. A pipe screw is provided for revolving and conveying the small ice bodies. The unit for proportioning and filling includes a filling chamber with a closure at the top thereof and with a closure at the bottom thereof. The bag storage housing has at least one inlet opening which is positioned in the region of the proportioning and filling unit. In addition, the bag storage housing has at least one opening for removing the filled bags. A unit for generating a veil of cold air and for lowering the storage temperature below the freezing point is positioned above the at least one removal opening.

The most significant advantage of the arrangement according to the present invention is to be seen in the fact that it can be mounted directly at the location where it is used. As a result, separate freezer rooms or containers and transport units having their own cooling systems are not required. Due to the compact construction, the loss of cold temperatures and, thus, the energy consumption can be kept low without negatively affecting the operation and manipulation of the arrangement.

In order to facilitate the work of the personnel operating the arrangement during proportioning and filling the small ice body into bags, particularly in large plants, preferably a work plate is positioned underneath the arrangement. Advantageously, the work plate is provided with a means for discharging the melted water.

In accordance with a preferred feature, the pipe screw mounted in the intermediate storage housing for loosening and transporting the small ice bodies rotates horizontally and is positioned above the outlet opening and has a right-hand and/or left-hand spiral. As a result, the small ice bodies can be conveyed from all sides without changing the direction of rotation of the screw to the outlet opening which may be positioned at any location.

In order to prevent the small ice bodies from freezing together particularly in large intermediate storage housings and in the case of long intermediate storage periods, additional rotating spiders may be provided.

In accordance with a preferred feature of the invention, the bottom plate in the intermediate storage housing is movably suspended from springs. Thus, in dependence upon the weight of the small ice bodies, the bottom plate is raised or lowered and, by means of limit switches provided in the intermediate storage chamber, the freezer unit is switched on or off in dependence on the removal of small ice bodies from the intermediate storage housing.

In accordance with an advantageous feature, the inlet opening to the bag storage housing is closed off by means of a strip-type curtain and the removal opening is closed off with a flap. The curtain and the flap have the purpose to make the interior of the bag storage housing easily accessible while preventing undesirably high cold temperature losses.

In accordance with a preferred feature of the invention, a slide plate is movably suspended from springs in the bag storage housing and is downwardly inclined from the inlet opening to the removal opening. Advantageously, the springs of the slide plate are dimensioned in such a way that the slide plate is lowered down to the housing bottom when the bag storage housing is full. As a result of this construction, it is ensured that even in the case of a square storage housing the filled bags are always collected in the region of the removal opening without reducing the storage capacity as is the case when a fixed slide plate is provided.

The unit for producing a veil of cold air in front of the removal opening and/or the inlet opening preferably is composed of a refrigerating machine and an evaporator and may include a ventilator. This unit also maintains the storage temperature underneath the freezing point, so that the small ice bodies in the bags are prevented from thawing.

The proportioning and filling unit is also a particularly important aspect of the present invention. The filling chamber of this unit preferably has scissors-type closures at the top and bottom thereof which can be opened and closed alternatingly.

In accordance with an advantageous feature, the closures at the bottom and at the top of the filling chamber can be actuated pneumatically or electromagnetically.

The filling chamber proper preferably is located directly underneath the outlet opening of the intermediate storage housing, so that the small ice bodies can fall into the filling chamber by force of gravity. This also has the result that the quantity of proportioned small ice bodies is always the same, independently of the actual size of the small ice bodies. In order to facilitate packing of the small ice bodies in the bags, the proportioning and filling unit is equipped with a holder for the bags.

A bag closing unit, preferably a welding unit for plastic foil, is provided for closing the bags.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

The single FIGURE of the drawing is a schematic sectional view of an arrangement for making, proportioning, discharging and storing small clear ice bodies according to the present invention.

DESCRIPTION OF THE PREFERRED EMBODIMENT

The illustrated embodiment of the arrangement according to the present invention includes two freezer units 10 of conventional construction which are arranged one above the other. The freezer units 10 include, for example, an evaporator with freezer cells, a water basin and a water spraying device. Refrigerating machines 11 produce the necessary freezing power. The number and size of the freezer units 10 can easily be adjusted to the desired requirements.

The small ice bodies 1 produced in the freezer units 10 fall directly into an insulated intermediate storage housing 20.

A bottom plate 21 is provided in the intermediate storage housing 20. The bottom plate 21 is movably suspended from springs 22 and is inclined toward an outlet opening 27 in the bottom of the intermediate storage chamber 20. In dependence on the weight of the small ice bodies on the bottom plate 21, the bottom plate 21 actuates limit switches 23 through which the freezer units 10 are switched on and off.

A pipe screw 25 fastened to a shaft 24 rotates above the outlet opening 27. Depending on the position of the outlet opening 27, the pipe screw 25 has a left-hand and/or right-hand spiral, so that the small ice bodies 1 can be conveyed from all sides of the intermediate storage housing 20 to the outlet opening 27 which may be located at any location in the bottom of the intermediate storage housing 20. The direction of rotation of the screw 25 can remain the same.

Rotating spiders 26 ensure that the small ice bodies 1 are safely prevented from freezing together even in large intermediate storage housings 20 and in the case of long intermediate storage periods.

A proportioning and filling unit 40 is mounted directly underneath the outlet opening 27 in the intermediate storage housing 20. The unit 40 includes a filling chamber 41 with closures 42 and 43 provided at the top and the bottom of the chamber, respectively. These closures 42, 43 are alternatingly opened and closed by means of a pneumatic cylinder or also by means of electromagnets. Particularly suitable are so called scissors-type closures whose operation is not negatively affected by the relatively coarse small ice bodies 1.

After the closure 42 at the top and the subsequent opening of the closure 43 at the bottom of the filling chamber 41, the small ice bodies proportioned in the filling chamber 41 drop into a bag 2. This bag is placed on a work plate 45 whose upper side is perforated and which is provided with a discharge line 46 for melted water resulting from storing ice bodies.

A commercially available bag closing unit 44, possibly a welding unit for plastic foil, is used for closing the bags 2.

An inlet opening 33 is provided immediately adjacent the proportioning and filling unit 40. The inlet opening 33 is closed by means of a curtain 33' of strip-type members. The filled and closed bags 3 can be thrown through the inlet opening 33 into an insulated storage housing 30.

A slide plate 31 is provided in the bag storage housing 30. The slide plate 31 is suspended from springs 32 and is downwardly inclined toward a removal opening 34. The slide plate 31 can drop down to the bottom 38 of the bag storage housing 30 as a result of the weight of the filled bags 3. This simplifies the removal of the bags 3 by an operator. The slide plate 31 constructed in this manner is a virtual necessity in the case of large capacities of the bag storage housing 30.

The removal opening 34 is closed by a flap 34'.

Above the removal opening 34 are provided a refrigerating machine 36 including an evaporator 37 which produce a veil 35 of cold air which prevents warm air from entering when the removal flap is opened. Of course, such a veil of cold air can also be produced in the region of the inlet opening 33.

The refrigerating machine 36 additionally ensures that the storage temperature in the storage housing 30 remains underneath the freezing point, for example at −5° C., so that the small ice bodies 1 in the closed bags 3 do not melt.

As already mentioned, the arrangement according to the present invention can be manufactured in any desired size and capacity depending on the requirements at a given location. The operation of the arrangement is simple. The small ice bodies are packed into the bags in a hygienic manner. The cold temperature losses and, thus, the energy requirements are minimal.

While a specific embodiment of the invention has been shown and described in detail to illustrate the application of the inventive principle, it will be understood that the invention may be embodied otherwise without departing from such principles.

I claim:

1. In an arrangement for making, proportioning, discharging and storing small clear ice bodies, the arrangement including at least one freezer unit for continuously producing small ice bodies from water, an insulated housing for an intermediate storage of the small ice bodies, the intermediate storage housing including a bottom with an outlet opening, the intermediate storage housing including means for revolving the small ice bodies and for conveying the small ice bodies to the outlet opening, a unit for proportioning and filling the small ice bodies into bags, and an insulated housing for storing the filled bags, the improvement comprising the at least one freezer unit being mounted above the intermediate storage housing and the intermediate storage housing being mounted above the bag storage housing, a bottom plate being mounted in the intermediate storage housing, the bottom plate being downwardly inclined toward the outlet opening, the unit for revolving and conveying the small ice bodies being a pipe screw, the proportioning and filling unit including a filling chamber having a top and a bottom, a closure each being provided at the top and the bottom of the filling chamber, the bag storage housing having at least one inlet opening positioned at the proportioning and filling unit and at least one removal opening for removing the filled bags, and a means for producing a veil of cold air and for lowering the storage temperature below the freezing point being positioned at least above the removal opening.

2. The arrangement according to claim 1, comprising a work plate positioned underneath the proportioning and filling unit.

3. The arrangement according to claim 2, wherein the work plate includes a water discharge line.

4. The arrangement according to claim 1, wherein the pipe screw is mounted horizontally, the pipe screw being positioned above the outlet opening and having a right-hand spiral and/or left-hand spiral.

5. The arrangement according to claim 1, comprising rotating spiders mounted in the intermediate storage housing above the bottom plate.

6. The arrangement according to claim 1, wherein the bottom plate is movably suspended from springs in the intermediate storage housing.

7. The arrangement according to claim 6, comprising end switches actuated by the bottom plate in dependence on the weight of the small ice bodies.

8. The arrangement according to claim 1, comprising a curtain of strip members for closing the inlet opening of the bag storage housing.

9. The arrangement according to claim 1, comprising a flap for closing the removal opening of the bag storage housing.

10. The arrangement according to claim 1, comprising a slide plate mounted in the bag storage housing, the slide plate being movably suspended from springs and being inclined downwardly from the inlet opening to the removal opening.

11. The arrangement according to claim 10, wherein the bag storage housing has a bottom, the springs of the slide plate having a strength selected such that the slide plate is lowered to the bottom of the bag storage housing when the bag storage housing is completely filled with filled bags.

12. The arrangement according to claim 1, wherein the means for producing the veil of cold air includes a refrigerating machine and an evaporator.

13. The arrangement according to claim 12, wherein the means for producing the veil of cold air further comprises a ventilator.

14. The arrangement according to claim 1, wherein the closures at the top and at the bottom of the filling chamber are scissors-type closures, the arrangement comprising means for alternatingly opening and closing the closures.

15. The arrangement according to claim 1, wherein the closures at the bottom and at the top of the filling chamber are actuated pneumatically.

16. The arrangement according to claim 1, wherein the closures at the bottom and at the top of the filling chamber are actuated electromagnetically.

17. The arrangement according to claim 1, wherein the proportioning and filling unit includes a holder for the bags.

18. The arrangement according to claim 1, wherein the proportioning and filling unit includes a bag closing means.

19. The arrangement according to claim 18, wherein the bag closing means is a welding device for plastic foil.

20. The arrangement according to claim 1, wherein the proportioning and filling unit is positioned directly underneath the outlet opening.

* * * * *